US007121847B1

(12) United States Patent
Jetton et al.

(10) Patent No.: US 7,121,847 B1
(45) Date of Patent: Oct. 17, 2006

(54) FLAME-RETARDANT CAP FOR A HIGH CURRENT CONNECTION

(75) Inventors: James T. Jetton, Ann Arbor, MI (US); Jeremy N. King, Ypsilanti, MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 11/064,007

(22) Filed: Feb. 24, 2005

(51) Int. Cl.
*H01R 12/00* (2006.01)

(52) U.S. Cl. ..... 439/76.2; 439/723

(58) Field of Classification Search ..... 439/76.2, 439/92, 212, 813, 718, 721–724; 411/84, 411/85, 107, 970
See application file for complete search history.

(56) References Cited

U.S. PATENT DOCUMENTS 4,541,538 A 9/1985 Swetnam
4,731,501 A 3/1988 Clark et al.
5,355,274 A * 10/1994 Marach et al. ..... 361/104
6,178,106 B1 1/2001 Umemoto et al.
6,322,376 B1 * 11/2001 Jetton ..... 439/76.2

* cited by examiner

*Primary Examiner*—Khiem Nguyen
(74) *Attorney, Agent, or Firm*—Daniel R. Edelbrock

(57) ABSTRACT

A flame-retardant shield or cap for isolating a fastener securing a high current connection to a conductor in a power distribution box (PDB) is manufactured separately from a much larger PDB cover that is not made from flame-retardant material. The cap has a closed end and sides forming an inner chamber for isolating the fastener from the cover and a surface of the PDB on which electrical components are received and mounted. The closed end and sides of the cap snap into a cup-shaped extension positioned on an underside of the cover such that when the cover is closed over the PDB an open end of the cap receives the fastener.

14 Claims, 4 Drawing Sheets

FLAME-RETARDANT CAP FOR A HIGH CURRENT CONNECTION

BACKGROUND OF THE INVENTION

1. Field of the Invention

The invention is directed in general toward an automotive power distribution box cover and more specifically to a flame retardant cap for mounting within the cover to fit over a high current connection.

2. Discussion of Related Art

An electrical junction block or power distribution box (PDB) is commonly used in automotive vehicles to streamline electrical system wiring by eliminating multi-branch wiring. The PDB consolidates fuses, branch circuits, relays, connectors and other electrical components in a single location. This is typically done by incorporating a bus bar or similar conductor into a housing. The housing often includes a surface having a plurality of receptacles for receiving the electrical connectors, fuses, relays and other circuit components. The bus bar is routed beneath the surface and has a plurality of blade-like projections that project into some or all of the receptacles to make electrical contact with the components. The bus bar is used to supply electrical power to the components for serving the vehicle electrical circuit requirements. The electrical power is usually provided to the bus bar through a power supply line from the vehicle alternator and/or battery.

As illustrated in U.S. Pat. No. 6,322,376, a high current connection between the vehicle battery and the PDB is often made by connecting power cables through a terminal to a plate section of the bus bar. A stud bolt mounted in a holder on the PDB extends through apertures in the terminal and bus bar plate section. A nut fastens the terminal onto the bus bar plate section. In this type of high current connection, if the terminal is improperly or inadequately connected to the bus bar, electrical arcing can ignite the PDB housing. In the above-identified patent, the stud bolt holder is made with flame-retardant material so it melts rather than ignites in the event of such a condition. Therefore, only the holder needs to be replaced, and the PDB housing is not damaged.

However, power distribution boxes are provided with plastic covers that are also in danger of igniting if the high current connection becomes loose. While wiring device covers are sometimes made of flame-retardant material, for example as disclosed in U.S. Pat. No. 4,541,538, covers for vehicle power distribution boxes have become rather large as the boxes have expanded in size to meet the increased electric circuit requirements of today's vehicles. Flame-retardant material is relatively expensive as compared to the traditional electrically non-conductive plastic material used for the covers. For production of large numbers of PDB covers, the augmented cost of making the entire covers from flame-retardant material becomes quite significant.

SUMMARY OF THE INVENTION

Accordingly, it is an object of this invention to provide a fireproof or flame-retardant shield or cap for a high current connection in a power distribution box.

Another object of the invention is to form the shield or cap such that it closely surrounds and isolates a fastener securing a high current connection terminal to a conductor in the power distribution box.

A further object of the invention is to enable the shield or cap to be readily attached to a power distribution box cover so the cover does not have to be made from a flame-retardant material.

In carrying out this invention in the illustrative embodiment thereof, an underside of a power distribution box (PDB) cover is provided with an integral cup-shaped extension in a location that would encompass a high current connection to the PDB when the cover is closed. The extension has an open end distal from the underside of the cover and apertures on sides of the extension adjacent the open end.

A separate shield or cap made from a fire-resistant or flame-retardant material has a closed end, an open end and sides extending between the ends and forming an inner chamber. On outward faces of opposite sides of the cap adjacent the open end of the cap are projections sized to fit within the apertures of the extension. On other opposite sides of the cap are ribs tapering from a maximum height adjacent the open end of the cap to a negligible or zero height at the closed end of the cap.

The closed end of the cap is inserted into the open end of the extension and pushed inward until the projections of the cap snap into the apertures of the extension. The ribs ensure a tight stable fit. When the cover is closed on the PDB, the cap surrounds and isolates the fastener electrically securing the high current connection to the PDB. Because the cap is flame-retardant it will not burn in the event the high current connection is loose or becomes loose and begins to arc. The separate cap eliminates the need for manufacturing the entire cover from the more expensive flame-retardant material.

BRIEF DESCRIPTION OF THE DRAWINGS

This invention, together with other objects, features, aspects and advantages thereof, will be more clearly understood from the following description, considered in conjunction with the accompanying drawings.

DETAILED DESCRIPTION OF THE ILLUSTRATED EMBODIMENT

Figure 1:
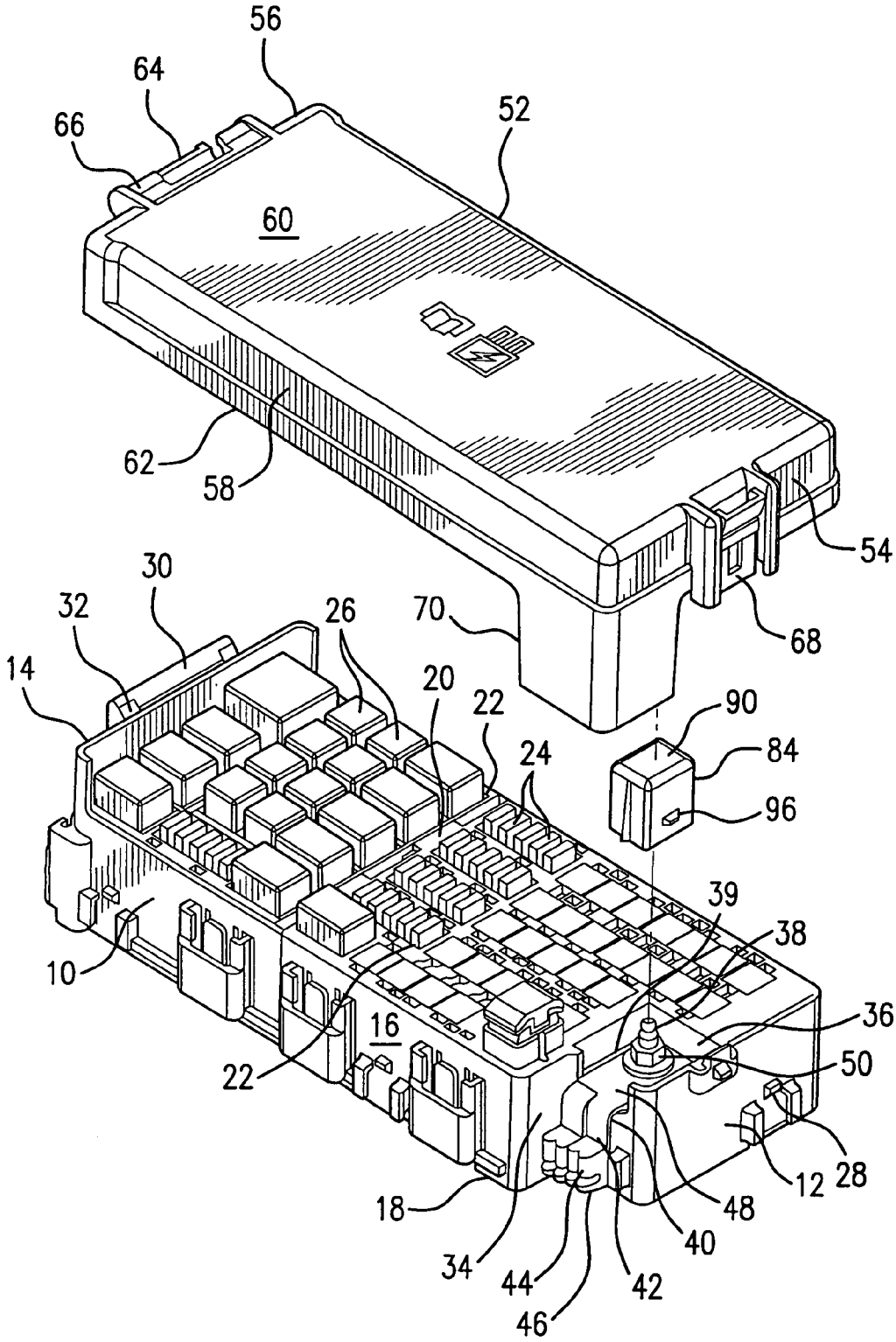
FIG. 1 is an exploded perspective view of a power distribution box with a high current connection, a cover, and a flame-retardant shield or cap for the connection according to the present invention.

Referring now to FIG. 1, a power distribution assembly includes a power distribution box (PDB) 10. The PDB is typically injection molded from a thermoplastic material. The power distribution box 10 has a first end 12, a second, opposite end 14, two sides 16, a bottom 18 and an upper surface 20. The upper surface 20 consists of variously sized and arranged receptacles 22 for receiving electrical components, such as fuses 24 and relays 26. The first end 12 has a simple latch tab 28 and the second end 14 has a hinge axle 30 extending between supports 32.

Immediately adjacent the first end 12 of the PDB at an in-set corner 34 is a recessed section 36 of the upper surface 20. The recessed section 36 is designed to receive a stud bolt holder (not shown) through the bottom 18 of the PDB, and a threaded shank 38 of a stud bolt extending from the holder. The recessed section 36 also accommodates a flat plate portion (hidden in the Figure) integral with a bus bar 39 for electrically connecting and conducting power to the electrical components inserted in the receptacles. The flat plate portion has an aperture through which the shank 38 extends. An electrical terminal 40 fits over and electrically contacts the plate portion, and also has an aperture through which the stud bolt shank 38 extends. The stud bolt holder, stud bolt, bus bar and flat plate portion of the bus bar are illustrated in commonly assigned U.S. Pat. No. 6,322,376, and that patent is incorporated herein by reference. However, this type of connection is depicted as an example only. The present invention can be used with other types of electrical connections and power distribution conductors, such as different-shaped terminals, non-threaded fasteners or reversed-in-position threaded fasteners, and routed wires or circuit traces within the PDB.

The electrical terminal 40 is a high current connection and is illustrated as a right-angle, electrically conductive metal terminal with a first section 42 having crimp tabs 44 and 46 for electrical and physical connection with power supply cables (not shown). A second section 48 of the terminal extends at a right angle from the first section and has an aperture for receiving the stud bolt shank 38. The second section 48 of the terminal fits over the plate portion of the bus bar and is tightened down into secured electrical contact with the plate portion by a nut 50 turned onto the threaded stud bolt shank 38.

The power distribution assembly further includes a one-piece cover 52 for the power distribution box. The cover is molded or otherwise formed from a relatively inexpensive and electrically non-conductive plastic material such as conventional polypropylene with ten percent talc. The cover 52 has a first end 54, a second end 56, two sides 58, a top surface 60 and an underside 62. A hinge cradle 64 and outer catches 66 at the second end of the cover engage and cooperate with the hinge axle on the second end 14 of the PDB 10 to enable the cover 52 to be swung or pivoted between open and closed positions over the PDB upper surface. This allows the cover to provide access to and protect the electrical components received in the receptacles 22 of the PDB upper surface 20. A latch arm 68 on the first end 54 of the cover cooperates with the latch tab 28 on the first end 12 of the PDB to lock the cover in a closed position over the PDB upper surface 20. The cover 52 also includes, at the first end 54, an elongated corner guard 70 for fitting around the in-set corner 34, terminal 40, and part of the perimeter of the recessed section 36 of the PDB.

Figure 2:
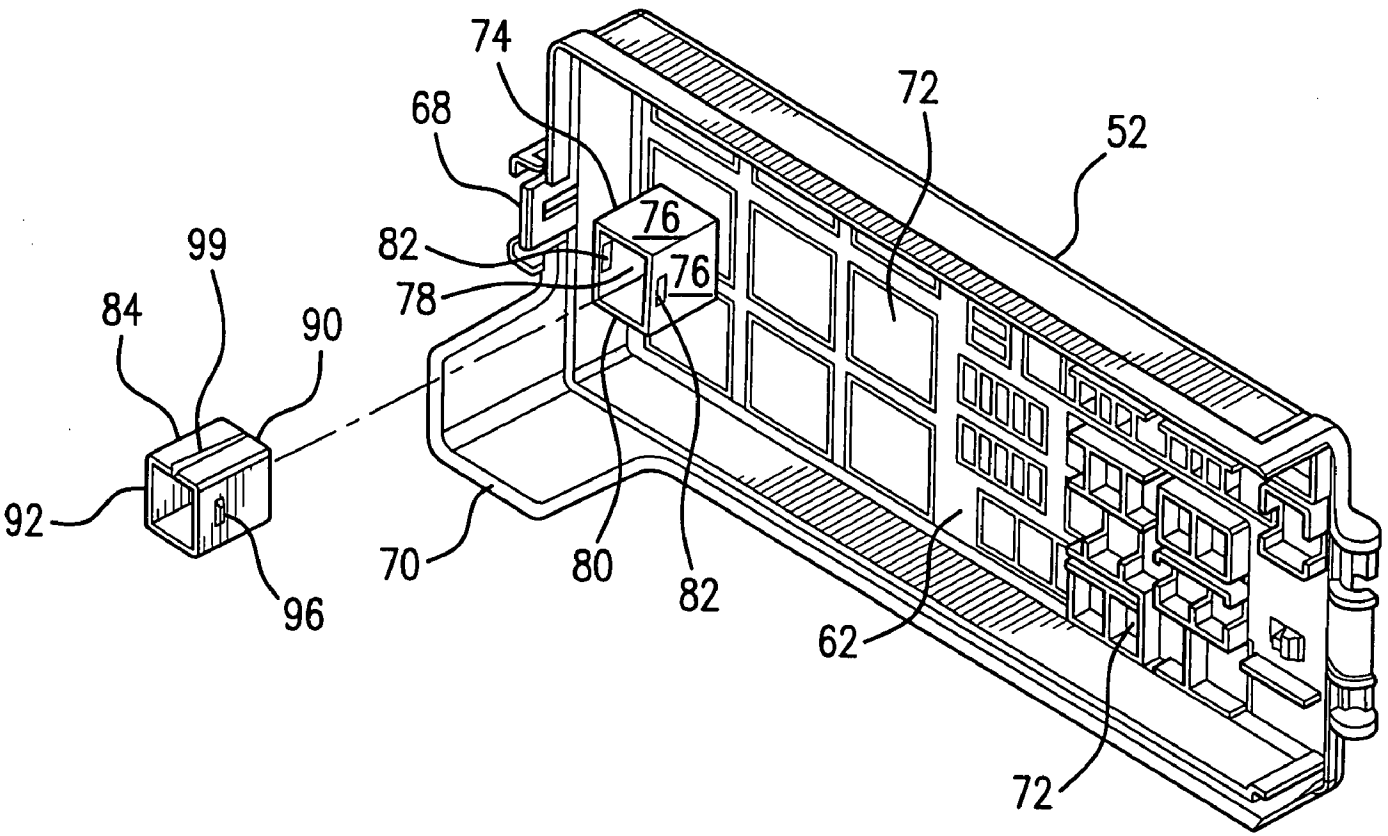
FIG. 2 is an exploded perspective view of the power distribution box cover and flame-retardant cap as viewed from an underside of the cover.
Figure 3:
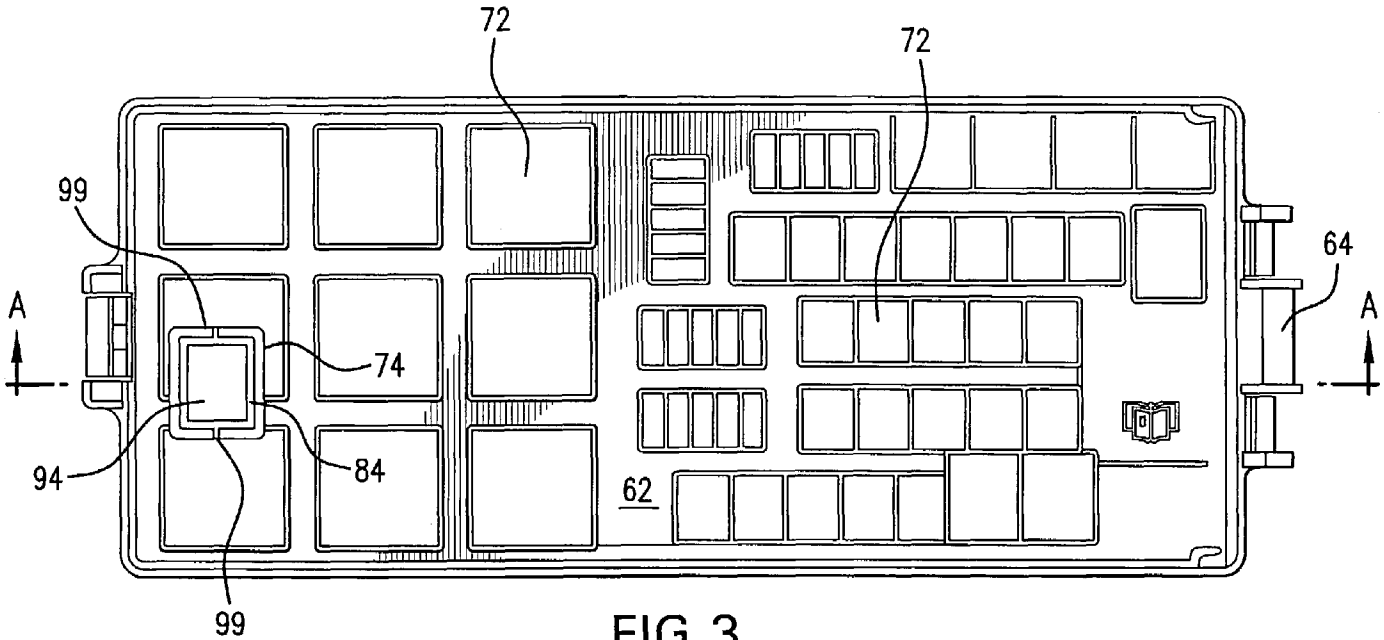
FIG. 3 is an underside view of the assembled cover and secured flame-retardant cap.
Figure 4:
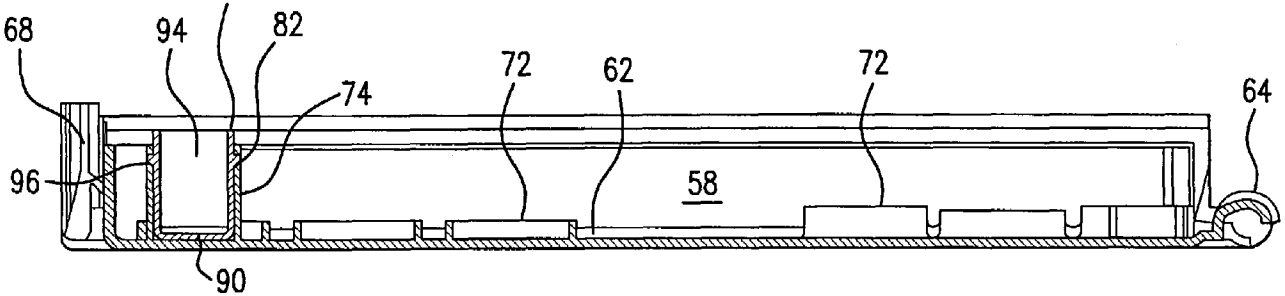
FIG. 4 is cross-sectional side view. taken on section line A—A of FIG. 3, illustrating the cover with attached cap.

Referring now to FIGS. 2–4, the underside 62 of the cover 54 is shown in more detail. The underside includes multiple recesses 72 sized and arranged in the same pattern as the receptacles 22 in the upper surface 20 of the PDB 10. The recesses, by receiving upper parts of the taller electrical components in the receptacles 22, provide rigidity and alignment features to the cover while enabling the cover to maintain a low profile on the PDB. This can be important in the engine compartments of vehicles, where space is limited.

An integral hollow, cup-shaped extension 74 extends from the underside 62 of the cover 52 adjacent the first end 54. The extension is molded as part of the cover and is positioned such that it would be located over the recessed section 36 of the PDB when the cover is closed on the PDB. The extension 74 has four sides 76 forming an inner rectangular cavity 78 with an insertion end 80. In two opposite sides 76 adjacent the insertion end 80 are rectangular shaped apertures 82.

Figure 5:
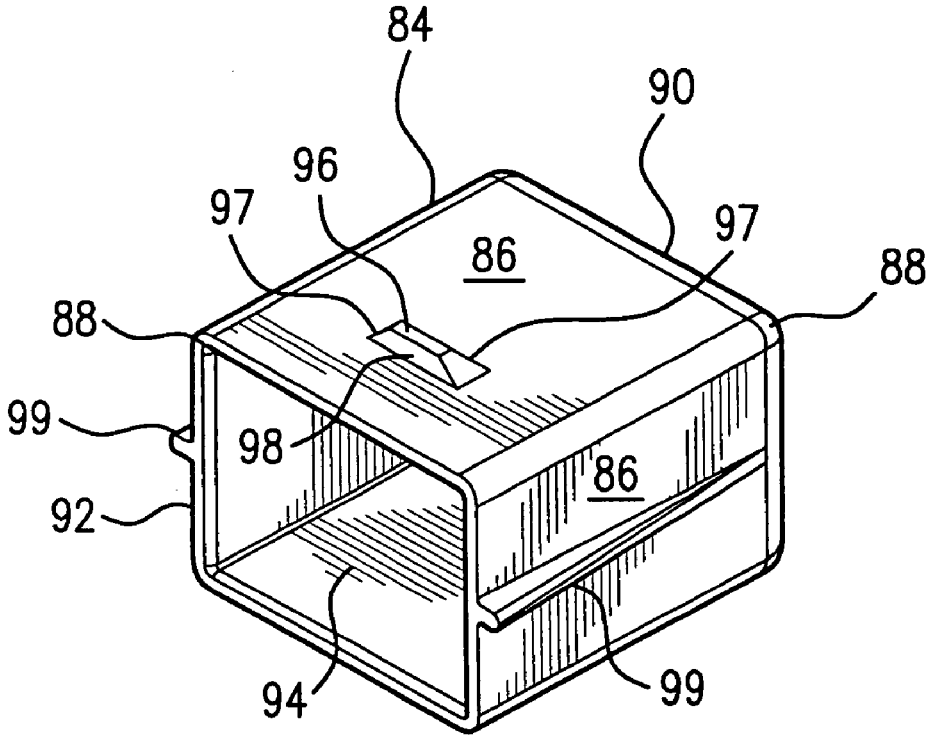
FIG. 5 is a perspective view of the cap.

A shield or cap 84, shown in all the Figures but best illustrated in FIG. 5, for the nut 50 or other type of fastener and the surrounding area of the second section 48 of the terminal 40, is sized to be received in the cover extension 74. The cap in effect forms a second, smaller part or section of the cover located within the perimeter of the underside of the cover. The cap 84 is rectangular with four sides 86 meeting at rounded corners 88, a closed end 90, an open end 92 and an inner chamber 94. A projection 96 protrudes from outer faces of two opposite sides 86 adjacent the open end 92. The projections 96 each have chambered or beveled edges 97 and a straight locking edge 98 facing toward the open end 92 of the cap. The projections are sized to be received in the apertures 82 of the extension 74 to provide cooperating latch means for securing the cap to the cover. On outer faces of the other two opposite 86 of the cap 84 are crush ribs 99. The crush ribs are configured as straight, narrow and rounded, and have maximum height at the open end 92 of the cap 84 tapering and diminishing to zero or negligible height at the closed 90.

The cap 84 is made from a fire-resistant or flame-retardant plastic material. An example of a material suitable for the cap is V0PBT, where V0 is the flame-retardant rating as specified by. Underwriter's Laboratory and PBT stands for polybutadiene terephthalte. Other types of flame retardant material could be used, depending on cost and effectiveness. The purpose of the cap is to prevent the cover 52 of the PDB 10 from igniting in the event of electrical arcing at the high current power connection. Another purpose of the cap is to avoid the necessity, and associated expense, of making the entire cover from flame-retardant material.

As demonstrated in FIG. 2, the closed end 90 of the cap 84 is pushed into the insertion end 80 of the cavity 78 in the extension 74, until the projections 96 on the sides 86 of the cap snap into the apertures 82 in the sides of the extension. The flexibility of the plastic material, the tapering design of the crush ribs 99 and the beveled edges 97 of the projections enable smooth operation with relatively low insertion force. The locked or latched position of the cap within the extension on the underside of the cover is illustrated in FIGS. 4 and 5. The crush ribs ensure a tight fit, stabilizing the cap and helping to prevent vibration. FIG. 1 shows how the cap would be positioned over and around the nut 50 and stud bolt shank 38 and against the surrounding area of the second section 48 of the terminal 40 when the cover 52 is secured to the PDB 10 and closed over the PDB surface 20. The nut, or any other type of fastener used, would be completely contained and isolated within the inner chamber 94 of the cap.

If the high current connection is inadequately tightened or loosens over time and creates an electric arc, the flame-retardant plastic material of the cap will not burn. By making the cap a separate part mountable within the cover, the PDB top cover does not need to be made of flame-retardant material. This provides a cost savings that can be as high as fifty percent when comparing the expense of a cover made entirely of a fireproof or flame-retardant material to a conventional-material cover with an attachable inner flame retardant cap.

It is possible to use, for example, a two-shot molding process to form the cap with the cover, but as a different fireproof material, eliminating the need for extension 74, although having the cap attachable and separate from the cover is less expensive and simplifies the mold and molding process. The attachment feature would also enable the cap to be positioned on the cover according to the location of the high current connection, which may vary with different power distribution boxes. The cover could be provided with multiple extensions 74 to give a choice of cap locations, or different shaped and sized covers with differently located extensions could all receive the same molded cap. The cover and cap concept could also be used in environments other than automotive vehicles, such as in electrical junction boxes for buildings.

The disclosed features provide an inexpensive, efficient and reliable way of firmly securing the cap to the cover but are not meant to limit the main concept of the invention. The cooperating latch means on the cap and extension could be replaced with other types of latch and lock devices. If tolerances could be made tighter the ribs 99 could be eliminated, or the ribs could be replaced with other types of fitting structure. The ribs could also be molded within the extension rather than on the cap to further reduce the use of flame-retardant material, though the cost savings would likely be small.

Since minor changes and modifications varied to fit particular operating requirements and environments will be understood by those skilled in the art, this invention is not considered limited to the specific examples chosen for purposes of illustration. The invention is meant to include all changes and modifications which do not constitute a departure from the true spirit and scope of this invention as claimed in the following claims and as represented by reasonable equivalents to the claimed elements.

What is claimed is:

1. A power distribution assembly comprising:

a surface for receiving electrical components;

means within the surface for electrically connecting the components;

a power supply terminal for electrical connection to an external source of power;

a fastener for securing the terminal to the electrically connecting means adjacent to the surface;

a cover for the surface, the cover having an underside; and a shield for the fastener, the shield extending from the underside of the cover and being made of a flame-retardant material.

2. The assembly of claim 1 wherein the shield has an open end and a closed end, and sides stretching between the ends and forming an inner chamber for isolating the fastener from the cover and the surface of the power distribution box.

3. The assembly of claim 1 wherein the flame-retardant material of the shield is a flame-retardant-rated polybutadiene terephthalte.

4. The assembly of claim 1 wherein the shield is received in an extension integral with the underside of the cover.

5. The assembly of claim 1 further comprising means for securing the shield to the underside of the cover.

6. A power distribution assembly comprising:

a surface for receiving electrical components;

means within the surface for electrically connecting the components;

a power supply terminal for electrical connection to an external source of power;

a fastener for securing the terminal to the electrically connecting means adjacent to the surface;

a cover for the surface, the cover having an underside; and a cap for the fastener, the cap and the underside of the cover having cooperating latch means for securing the cap to the underside of the cover, the cap being made of a flame-retardant material.

7. The assembly of claim 6 wherein the electrically conducting means is a bus bar and wherein the bus bar and terminal have apertures through which a stud bolt shank in the power distribution box extends, and the fastener comprises the stud bolt shank and a nut for securing the bus bar and terminal together on the shank.

8. The assembly of claim 6 wherein the cap has an open end, a closed end, and sides enclosing an inner chamber between the ends, the cap receiving the fastener through the open end and isolating the fastener from the cover and the surface when the cover is closed over the surface.

9. The assembly of claim 8 further including an extension extending from the underside of the cover, the cooperating latch means comprising apertures in the extension and projections protruding from the sides of the cap.

10. The assembly of claim 9 wherein the projections are located adjacent the open end of the cap.

11. The assembly of claim 10 wherein the projections have beveled edges.

12. The assembly of claim 9 wherein the extension is cup-shaped with sides and an open end distal from the underside of the cover, the closed end and sides of the cap being sized to be received within the open end of the extension.

13. The assembly of claim 12 further including ribs on the sides of the cap for contacting the sides of the extension and ensuring a tight fit.

14. The assembly of claim 13 wherein the ribs taper from a maximum height adjacent the open end of the cap to a negligible height at the closed end of the cap.

* * * * *